US009533817B2

(12) United States Patent
Smallwood

(10) Patent No.: US 9,533,817 B2
(45) Date of Patent: Jan. 3, 2017

(54) SELF AIR EVACUATING SYSTEM

(76) Inventor: Dale O. Smallwood, Kamuela, HI (US)

( * ) Notice: Subject to any disclaimer, the term of this patent is extended or adjusted under 35 U.S.C. 154(b) by 232 days.

(21) Appl. No.: 11/714,656

(22) Filed: Mar. 6, 2007

(65) Prior Publication Data

US 2007/0215624 A1 Sep. 20, 2007

Related U.S. Application Data

(60) Provisional application No. 60/783,984, filed on Mar. 20, 2006.

(51) Int. Cl.
*B65D 81/24* (2006.01)

(52) U.S. Cl.
CPC ..... *B65D 81/245* (2013.01)

(58) Field of Classification Search
CPC ..... B65D 81/245; B65D 88/34
USPC ..... 220/578, 803, 804, 805, 806, 787, 801,220/579, 580, 221; 215/231, 247, 249; 604/415
See application file for complete search history.

(56) References Cited

U.S. PATENT DOCUMENTS 2,190,203 A * 2/1940 Barnard ..... 220/578
3,119,541 A * 1/1964 Lynn ..... 229/5.5
3,164,289 A * 1/1965 Cocchiarella ..... 220/578
3,458,079 A * 7/1969 Gasbarra ..... 220/787
3,494,499 A * 2/1970 Kramer et al. ..... 220/8
3,737,063 A * 6/1973 Loup ..... 215/211
3,779,371 A * 12/1973 Rovinski ..... 206/221
3,781,942 A * 1/1974 Coleman ..... 15/246.5
3,811,590 A * 5/1974 Hall, Jr. ..... 215/207
3,900,122 A * 8/1975 Dichter ..... 215/43
3,924,774 A * 12/1975 Donnelly ..... 220/580
3,984,022 A * 10/1976 Babiol ..... 215/355
3,987,941 A * 10/1976 Blessing ..... 222/386
4,335,827 A * 6/1982 Knize et al. ..... 220/284
5,680,946 A * 10/1997 Cochran ..... 215/317
6,296,131 B2 10/2001 Rashid
6,945,014 B1 9/2005 Quann
7,159,736 B1 * 1/2007 Torelli ..... 220/578
7,255,244 B2 * 8/2007 Miller ..... 220/578
2003/0201239 A1 * 10/2003 Hudak et al. ..... 215/247

* cited by examiner

*Primary Examiner* — James N Smalley
(74) *Attorney, Agent, or Firm* — James Ray & Associates

(57) ABSTRACT

In combination with a container having predetermined shape, the improvement comprising an apparatus for evacuating air from the container and for sealing the container so as to prevent air from returning in order to better preserve contents of the container. The apparatus includes a lid member for insertion into such container, the lid member having each of a predetermined shape and a predetermined size and formed of a predetermined material and at least one rim member formed on an outer edge of the lid member for contacting an inside wall of the container. The at least one rim member being sufficiently thin so as conform to the inside walls of said container.

13 Claims, 3 Drawing Sheets

SELF AIR EVACUATING SYSTEM

CROSS REFERENCE TO RELATED APPLICATIONS

This application is closely related to and claims benefit from U.S. Provisional Application Ser. No. 60/783,984 filed Mar. 20, 2006.

FIELD OF THE INVENTION

The present invention relates, in general, to a container, and, more particularly, the present invention relates to a lid and container arrangement wherein at least most of the air present in the container is removed by the lid thereby providing that the contents in such container are stored in substantially a vacuum.

BACKGROUND OF THE INVENTION

When jarred or canned products contain only a partial amount of the product, the resulting air space can lead to prematurely stale or spoiled foods, diminished potency of prescription drugs and/or vitamins and dried out coffee, tea or tobacco. The cookies in a large plastic jar with a screw-on lid will go stale quickly when the jar is only half filled with cookies. All of the excess air in the jar makes the cookies go stale in very short order. Excess air dehydrates the jarred products that need to remain moist. The moisture content of the air space adversely affects items that need to be dry and crisp such as chips, pretzels or cookies. The spoilage results in waste and unnecessary incurred replacement of costs for the food.

Thus, it would be advantageous if there were a means or apparatus available that could eliminate the air trapped in inside containers that would otherwise ruin the food products stored therein.

SUMMARY OF THE INVENTION

In a first aspect the present invention provides in combination with a container having a predetermined shape, the improvement comprises an apparatus for evacuating air from the container and for sealing the container so as to prevent air from returning in order to better preserve contents of the container. The apparatus includes a lid member for insertion into such container, the lid member having each of a predetermined shape and a predetermined size and formed of a predetermined material and having at least one rim member formed on an outer edge of the lid member for contacting an inside wall of the container. The at least one rim member being sufficiently thin so as conform to the inside walls of said container.

In a second aspect the present invention provides an apparatus for evacuating air from a container and sealing such container so as to prevent air from returning in order to better preserve the contents of such container. The apparatus comprises a lid member for inserting in such container, such lid member has a predetermined shape and size and is formed of a predetermined material and at least one rim member that is formed on the lid member for contacting an inside wall of such container. The at least one rim member being sufficiently thin so as conform to such inside walls of such container.

In yet another aspect the present invention provides an apparatus designed for evacuating air from a container so as to protect products stored inside. The apparatus comprises a container having a first predetermined shape and made of a first predetermined material, the container having a plurality of horizontal ribs disposed on an inner surface of such container and a first lid member having a second predetermined shape and formed of a second predetermined material. Such first lid member is designed for fitting inside the container, the first lid member engages the plurality of horizontal ribs disposed on the inside surface of the container wherein the lid member is pushed down over the plurality of horizontal ribs and placed level on a desired rib for eliminating excess air from such container creating a substantially airtight seal thereby protecting the contents of the container.

OBJECTS OF THE INVENTION

It is, therefore, one of the primary objects of the present invention is to provide an apparatus for evacuating air from a container.

Another object of the present invention is to provide an apparatus for evacuating air from a container that is simple to use.

Still another object of the present invention is to provide an apparatus for evacuating air from a container that can be used with a variety of containers.

Yet another object of the present invention is to provide an apparatus for evacuating air from a container regardless of the shape of the container.

These and various other objects and advantages of this invention will become apparent after a full reading of the following detailed description, particularly, when read in conjunction with the attached drawings as described below and the appended claims.

Figure 1:
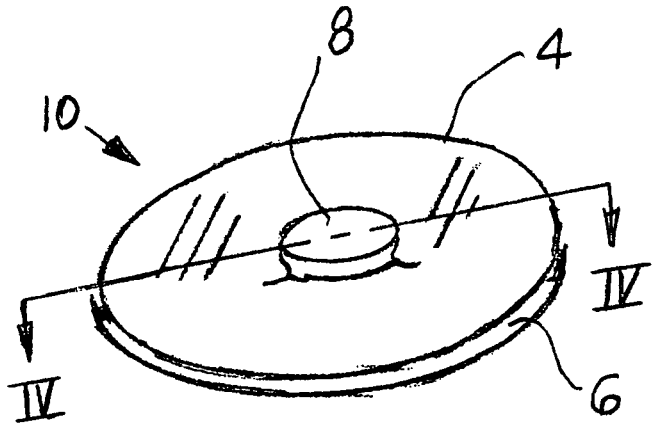
FIG. 1 is a perspective view of the apparatus according to an embodiment of the invention.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

In a first aspect the present invention provides in combination with a container 2, an apparatus, generally designated 10, for evacuating air from the container 2 and for sealing the container 2 so as to prevent air from returning in order to better preserve the contents of the container 2. The improvement comprises a lid member 4 for insertion into such container 2, the lid member 4 having each of a predetermined shape and a predetermined size and formed of a predetermined material and at least one rim member 6 formed on an outer edge of the lid member 4 for contacting an inside wall of the container 2. The at least one rim member 6 being sufficiently thin so as conform to the inside walls of the container 2.

Figure 3:
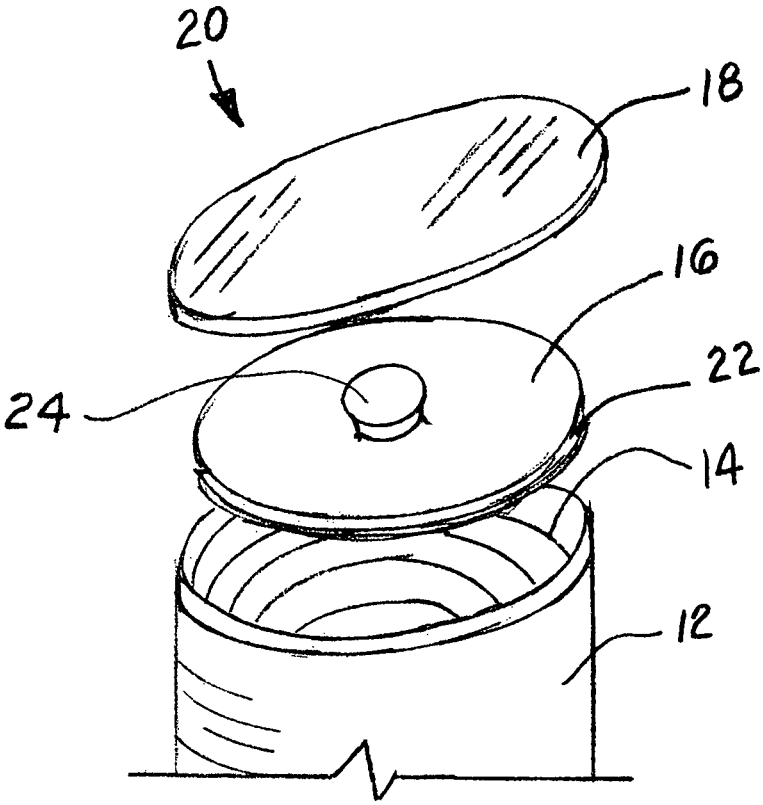
FIG. 3 is a perspective view of a container with a first lid and a second lid.
Figure 2:
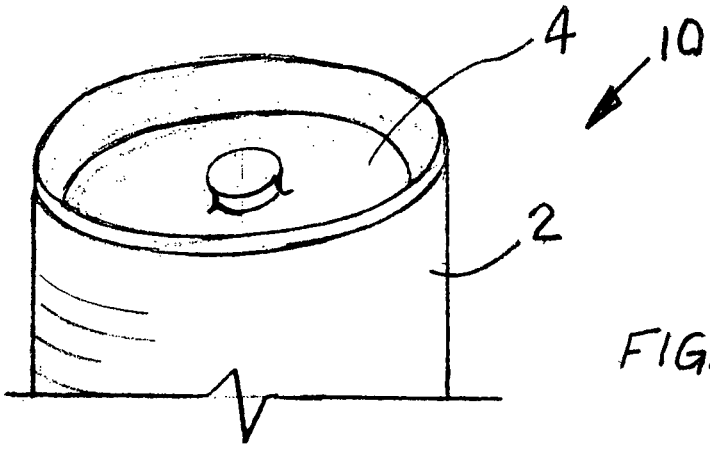
FIG. 2 is a perspective view of a container with the apparatus shown in FIG. 1 disposed in the container.
Figure 6:
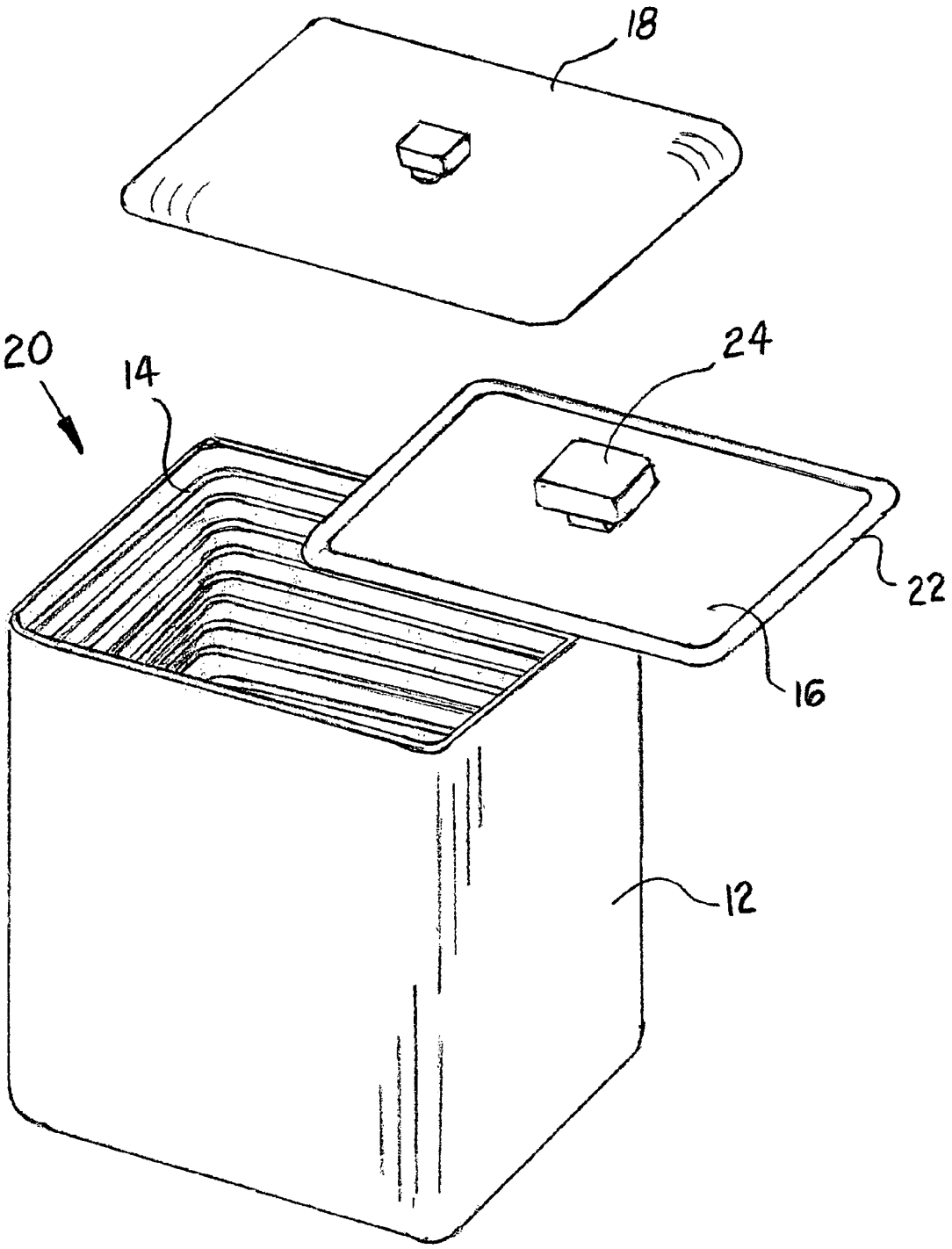
FIG. 6 is perspective view of the apparatus shown in FIG. 3 showing the apparatus with a different shape.

Although most of the discussion will be with regards to circular or cylindrical containers; however, it should be noted that the present invention is applicable to containers with other shapes. These containers can be rectangular, hexagonal, octagonal or any other similar shape. FIGS. 3 and 6 show a circular and a rectangular shaped container. It is only important that the lid member 4 be formed so as to correspond to the shape of the container 2. So if the container 2 is cylindrical the lid member 4 is circular, if the container 2 is square then the lid member 4 is also square. In either case it is important that the rim member 6, the outer edge of the lid member 4, be sufficiently thin enough so as to conform to the sides of the container 2 and form a seal with the sides of the container 2.

Figure 4:
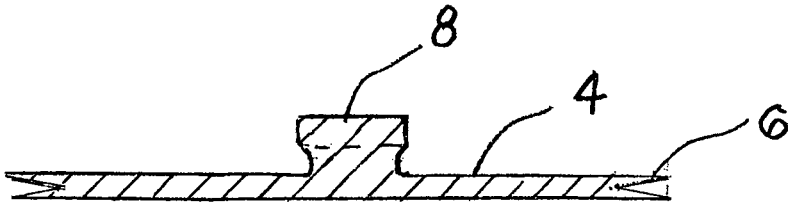
FIG. 4 is a cross sectional view of the apparatus shown in FIG. 1 taken across the lines IV-IV.
Figure 5:
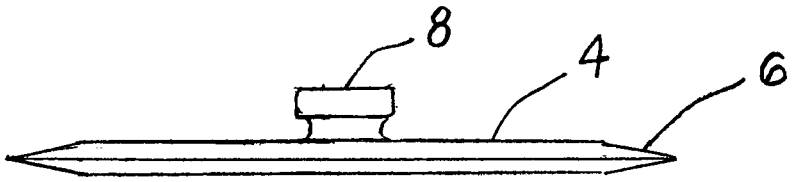
FIG. 5 is a cross sectional view similar to FIG. 4 but showing a different rim member.

As is clearly seen in FIG. 5 such lid member 4 has a central portion that has a substantially uniform thickness and then generally tapers from such center portion to a point on the outer end. Such end is rim member 6. As can be seen such rim member 6 is integrally formed as part of the lid member 4. FIG. 4 shows an embodiment where such lid member 4 has two rim members 6 formed on an outer end thereof.

It must be understood that such rim member 6 must be flexible so it can conform to the inside of the container 2. The predetermined shape of the lid member 4 is such that it generally tapers from a center portion to substantially a point on an outer edge of the lid member 4 forming the at least one rim member 6. Such lid member 4 further includes a handle member 8, such handle member 8 is formed on an upper surface of the lid member 4 for ease of inserting the lid member 4 into the container 2 and for removing the lid member 4 from the container 2. The lid member 4 is pushed into the container 2 at a slight angle so that the air in the container 2 is forced out. When the lid member approaches whatever product is stored inside, the lid member 4 is made essentially level, leaving the product inside in substantially an air free atmosphere. The product is not in a vacuum but such product will be substantially air free. This will improve the storage life of the product and in many cases the product will retain the fresh taste and aroma that it had when the container was first opened. This can be noticed quite readily with coffee as air will affect the taste and aroma in a short period of time which is the reason that such products are sold as vacuum packs. In an alternate embodiment of the invention, shown in FIG. 4, instead of only one rim member 6 on the outer edge of the lid member 4 there are two rim members 6. The multiple rim members 6 can provide a better seal than the single rim member 6.

In a second aspect the present invention provides an apparatus 10 for evacuating air from a container 2 and sealing such container so as to prevent air from returning in order to better preserve the contents of such container 2. The apparatus 10 comprises a lid member 4 for inserting in such container, such lid member 4 has a predetermined shape and size and is formed of a predetermined material and has at least one rim member 6 that is formed on the outer edge of the lid member 4 for contacting an inside wall of such container 2. The at least one rim member 6 being sufficiently thin so as conform to such inside walls of such container 2.

In yet a third aspect the present invention provides an apparatus 20 designed for evacuating air from a container 2 so as to protect products stored inside. The apparatus 20 comprises a container 12 having a first predetermined shape and made of a first predetermined material, the container has a plurality of horizontal ribs 14 disposed on an inner surface of such container 12 and a first lid member 16 having a second predetermined shape and formed of a second predetermined material. Such lid member 16 is designed for fitting inside the container 12, the first lid member 16 engages the plurality of horizontal ribs 14 disposed on the inside surface of the container wherein the first lid member 16 is pushed down over the plurality of horizontal ribs 14 and placed level on a desired rib 14, close to the product inside the container, for eliminating excess air from such container 12 creating a substantially airtight seal thereby protecting the contents of the container 12.

The apparatus 20 further includes a second lid member 18. The second lid member 18 being secured to the top of the container 12 for use as a dust cover to prevent dust and extraneous material from entering said container 12 after such first lid member 16 has been pushed down into said container.

The first lid member 16 has at least one flexible rim 22 disposed around an outer periphery thereof. The first lid member 16 tapers from a center portion to substantially a point on an edge of the first lid member 16 forming the at least one rim member 22. Such rim member 22 is thin enough so as to be able to conform to an inner wall of the container 12. The flexible rim 22 of first lid member 16 is thin enough so as to be able to be tilted as the first lid member 16 is pushed down into the container 12 to evacuate the air that is present in the container 12. Such first lid member 16 further includes a handle member 24 disposed on an upper surface thereof.

Thus the present invention provides a means and apparatus that will minimize the residual that is left in a container by providing a flexible lid that fits in such container and which evacuates the residual air as the lid is pressed down into the container. The lid member can be used with a variety of containers provided the lid and containers are matched as to size.

The apparatus further includes containers that have a plurality of ribs disposed on the interior of the container and a flexible lid member that fits into such container. It is important the rim member (the outer edge of the lid) by thin and very flexible. The apparatus does not provide a complete vacuum but it does remove most of the air and thus can prolong the shelf life of the product in the container that would otherwise be adversely affected by the presence of air.

While a presently preferred embodiment and alternate embodiments of the present invention has been described in detail above, it should be understood that various other adaptations and/or modifications of the invention can be made by those persons who are particularly skilled in the art without departing from either the spirit of the invention or the scope of the appended claims.

I claim:

1. In combination with a container having a predetermined shape and a predetermined number of rib members formed on an inner surface of said container the improvement comprising an apparatus for evacuating air from said container and for sealing said container so as to prevent air from returning in order to better preserve contents of said container, said apparatus including:

(a) a lid member configured for insertion into said container, said lid member including a body having each of a pair of spaced apart surfaces defining a generally uniform thickness of said body, said lid member further including a predetermined shape and a predetermined size and being formed of a predetermined material; and (b) at least one flexible rim member integrally formed on and defining an outer edge of said lid member, said at least one flexible rim member tapering between planes defined by said pair of spaced apart surfaces to substantially a point on an outer edge of said lid member, said at least one flexible rim member sized for contacting at least one of an inside wall of said container, a bottom surface of a first one of said rib members, an upper surface of a second one of said rib members disposed below said bottom surface of said first one of said rib members and an inner most surface of said rib members, said at least one rim member being sufficiently thin so as conform to said at least one of said inside walls of said container, said bottom surface of said first one of said rib members, said upper surface of said second one of said rib members disposed below said bottom surface of said first one of said rib members, said inner most surface of said rib members and a combination of said bottom surface of said first one of said rib members, said upper surface of said second one of said rib members disposed below said bottom surface of said first one of said rib members and said inner most surface of said rib members.

2. The combination, according to claim 1, wherein said substantially point disposed mediate said planes of said pair of spaced apart surfaces.

3. The combination, according to claim 1, wherein said lid member further includes a handle member, said handle member formed on an upper surface of said lid member for ease of inserting said lid member into said container and for removing said lid member from said container.

4. The combination, according to claim 1, wherein said at least one flexible rim member is two rim members disposed coplanar with said pair of surfaces thereof and defining a generally V-shaped peripheral notch in said outer edge of said lid member.

5. An apparatus comprising:

(a) a container having a predetermined number of circumferential rib members formed on an inner surface thereof in a spaced apart relationship with each other along height or length of said container;

(b) a lid member configured for insertion into said container, said lid member including a body having a pair of spaced apart surfaces defining a generally uniform thickness of said body, said lid member further including a predetermined shape and size and being formed of a predetermined material; and (c) at least one flexible rim member integrally formed on and defining an outer edge of said lid member, said at least one flexible rim member tapering between planes defined by said pair of spaced apart surfaces to substantially a point on an outer edge of said lid member, said at least one flexible rim member sized for contacting at least one of an inside wall of said container, a bottom surface of a first one of said rib members, an upper surface of a second one of said rib members disposed below said bottom surface of said first one of said rib members and an inner most surface of said rib members, said at least one rim member being sufficiently thin so as conform to said at least one of said inside walls of said container, said bottom surface of said first one of said rib members, said upper surface of said second one of said rib members disposed below said bottom surface of said first one of said rib members, said inner most surface of said rib members and a combination of said bottom surface of said first one of said rib members, said upper surface of said second one of said rib members disposed below said bottom surface of said first one of said rib members and said inner most surface of said rib members.

6. The apparatus, according to claim 5, wherein said substantially point disposed mediate said planes of said pair of spaced apart surfaces.

7. The apparatus, according to claim 5, wherein said lid member further includes a handle member, said handle member formed on an upper surface of said lid member.

8. The apparatus of claim 5, wherein said lid member is configured for said insertion at an angle.

9. An apparatus designed for evacuating air from containers so as to protect products stored inside, said apparatus comprising:

(a) a container having a first predetermined shape and made of a first predetermined material, said container having a plurality of horizontal closely spaced ribs disposed on an inner surface of said container;

(b) a first lid member including a body having a pair of spaced apart surfaces defining a generally uniform thickness of said body, said first lid further including at least one flexible rim member integrally formed on and defining an outer edge of said lid member, said at least one flexible rim member tapering between planes defined by said pair of spaced apart surfaces to substantially a point on an outer edge of said lid member, said first lid additionally including a second predetermined shape and being formed of a second predetermined material, said first lid member designed for fitting inside said container, said at least one flexible rim member engages said plurality of horizontal closely spaced ribs disposed on said inside surface of said container wherein said first lid member is pushed down over said plurality of horizontal ribs and placed level on a desired rib for eliminating excess air from said container creating a substantially airtight seal thereby protecting contents of said container; and (c) a second lid member disposed over an outer edge of said container.

10. The apparatus, according to claim 9, wherein said substantially a point disposed mediate said planes of said pair of spaced apart surfaces.

11. The apparatus, according to claim 10, wherein said rim member is thin enough so as to be able to conform to at least one of an inner wall of said container, a bottom surface of a first one of a plurality of rib members, an upper surface of a second one of said rib members disposed below said bottom surface of said first one of said rib members, an inner most surface of said rib members and a combination of said bottom surface of said first one of said rib members, said upper surface of said second one of said rib members disposed below said bottom surface of said first one of said rib members and said inner most surface of said rib members.

12. The apparatus, according to claim 11, wherein said flexible rim of first lid member is thin enough so as to be able to be tilted as said first lid is pushed down into said container to evacuate air present in said container.

13. The apparatus, according to claim 9, wherein said first lid member further includes a handle member disposed on an upper surface thereof.

* * * * *